United States Patent [19]

Leibrecht

[11] 3,959,690

[45] May 25, 1976

[54] CORONA DISCHARGE ELEMENT

[75] Inventor: Klaus Leibrecht, Hofheim, Germany

[73] Assignee: Hoechst Aktiengesellschaft, Frankfurt, Germany

[22] Filed: Oct. 4, 1974

[21] Appl. No.: 512,201

Related U.S. Application Data

[63] Continuation of Ser. No. 342,627, March 19, 1973.

[30] Foreign Application Priority Data

Mar. 20, 1972 Germany ..... 2213425

[52] U.S. Cl. ..... 317/4; 55/152; 313/351; 317/262 A

[51] Int. Cl.[2] ..... H01T 19/04

[58] Field of Search ..... 317/262 A, 4; 250/324, 250/325, 326; 55/152; 83/852; 313/351

[56] References Cited

UNITED STATES PATENTS

| | | | |
|---|---|---|---|
| 2,117,586 | 5/1938 | Willson | 83/852 |
| 3,718,029 | 2/1973 | Gourdine et al. | 55/152 |

*Primary Examiner*—R. N. Envall, Jr.
*Assistant Examiner*—Harry E. Moose, Jr.
*Attorney, Agent, or Firm*—Stevens, Davis, Miller & Mosher

[57] ABSTRACT

A corona discharge element, process for manufacturing the corona discharge element and a corona device including the corona discharge element. The element is a metal strip with peaks on one side thereof alternately positioned in the plane of one side of the strip and then the other with the peaks having the shape of a four-sided pyramid and one side of the pyramid lying in the plane of the surface of the strip. The process includes grinding the teeth of a saw blade to assume pyramidal shape. The corona device includes a frame, a corona discharge element, laminar auxiliary electrodes and grid electrode in which the element, laminar electrodes and grid electrode are electrically insulated from each other and have electrical connections thereto.

6 Claims, 4 Drawing Figures

22
17
13
IIIb
IIIb
12
14
20
20
15
15
16
21

14
13
20
20
17
2
1
16
15
15
21

J
(mA)
0,7
0,6
0,5
0,4
0,3
0,2
0,1
0
3
4
5
6
7
8
9
10
U
34
12
10
210 mm
7
8
9
10
11
12

CORONA DISCHARGE ELEMENT

This is a continuation of application Ser. No. 342,627, filed Mar. 19, 1973.

The present invention relates to a corona discharge element which comprises several electrically conductive peaks which may be connected to a high voltage source.

The generation of corona discharges, such as are used, e.g., for the ionization of gases or, in particular, for the electrical charging of surfaces, generally involves the problem that a relatively high field intensity must be produced on metal surfaces without having to use too high an electrical voltage. For this purpose, use is made of the well known phenomenon that the electrical field strength at a conductive surface may be considerably increased by giving this surface a strong curvature.

In a known corona discharge element, a very thin wire of exceptionally strong material is used. Normally, the wire has a diameter of the order of 50 $\mu$ so that an appropriate field strength is produced on the wire surface at a voltage of several kV. Such corona wires are relatively difficult to process and the adjustment of a defined tensile stress poses additional problems. When the corona wires are relatively long, they are prone to mechanical vibrations, which can not be suppressed, not even by submitting the wires to a tensile stress near their breaking point.

Further, a corona discharge element has been proposed which is in the form of a cutting edge. It was not possible, however, to improve the discharge characteristics of cutting edges to such a degree that they could be used more widely in corona discharge apparatuses.

Of course, needle-shaped discharge elements have very good discharge characteristics. Corona devices of this type comprise several needles which are conductively connected to each other and to a high voltage source. At voltages around 6 kV, however, such needle coronas possess only good discharge characteristics when the distance between the needles is relatively great, and if only one of the needles fails to operate, serious charging faults result. Further, the production of such needle coronas is relatively expensive, because each needle must be individually mounted in a guide element.

Flat steel electrodes of semi-circular profile have already been proposed for use in the field of electrical filters, however, such electrodes did not comply with the high requirements made in the electrophotographic field. This is perhaps due to the fact that the profiled flat steel electrodes possessed only blunt cutting edges as the actual discharge elements, whose length corresponded to the thickness of the steel. On the other hand, a reduction of the thickness of the steel was limited by mechanical difficulties (breaking strength, vibrations, mounting).

It is an object of the present invention to provide a corona discharge element of the above described type which does not have the above mentioned drawbacks and whose manufacture is easy and inexpensive. Further, the corona discharge element should be of high tear strength and its discharge characteristics should be excellent.

According to the present invention, this object is achieved by a corona discharge element of the above defined type which is characterized in that the discharge peaks are connected to and form part of a metal strip and that the corona discharge element resembles a saw blade.

In a preferred embodiment of the corona discharge element according to the present invention, the peaks are of approximately pyramidal shape. A corona discharge element of this type in which the peaks are alternately arranged to the right and to the left of a plane extending in the strip, can be produced at particularly favorable prices and has excellent discharge characteristics, especially when the peaks are spaced at approximately equal distances from each other.

The corona element according to the present invention combines the characteristics of high tear strength, straightness, and indifference to transverse oscillation, on the one hand, with excellent discharge characteristics, because in a single piece of metal, the web-like base element provides the desired mechanical strength, whereas peaks protruding from this web and forming part of it take the function of generating the discharge. Although a conventional saw blade is incapable of producing a satisfactory discharge, it has been found that it is possible, and comes within the scope of the present invention, to manufacture a corona discharge element of the above described type in a particularly simple and inexpensive manner by using a conventional, commercially available saw blade of the desired length with set teeth and removing the laterally projecting portions of the teeth. Only as much material is removed as is necessary to convert the teeth into pyramidal peaks. This does in no way alter the mechanical strength of the corona element, because its strength is determined solely by the strip of metal. By grinding off the laterally projecting portions of the teeth, however, a corona discharge element is produced which is distinguished by an excellent discharge capacity. The corona discharge element is produced in a particularly simple manner when saw blades are used whose setting corresponds to their thickness, because in this case it is only necessary to surface-grind the saw blades.

The present invention relates also to a corona discharge apparatus which is characterized by a combination of the following elements:

a. a frame in which the elements b, c, and d are arranged in such a manner that they are electrically insulated from each other, b. at least one corona discharge element resembling a saw blade which comprises a flat metal strip and, connected to and forming part of said strip, discharge peaks which point to the charge-accepting surface, c. laminar auxiliary electrodes arranged to both sides of the discharge element and parallel to it, d. a grid electrode arranged between the discharge element and the auxiliary electrodes on the one side and the charge-accepting surface on the other side, and e. electrical connections for each of the three elements b, c, and d.

The present invention will be described in more detail by reference to the preferred embodiment shown in the drawing.

In the drawing,

FIG. 1 shows part of a corona discharge element of the shape of a saw blade. The corona discharge element comprises an electrically conductive metal strip 1 and discharge peaks 2 forming part thereof and protruding from the strip in the way of saw teeth.

Figure 1:
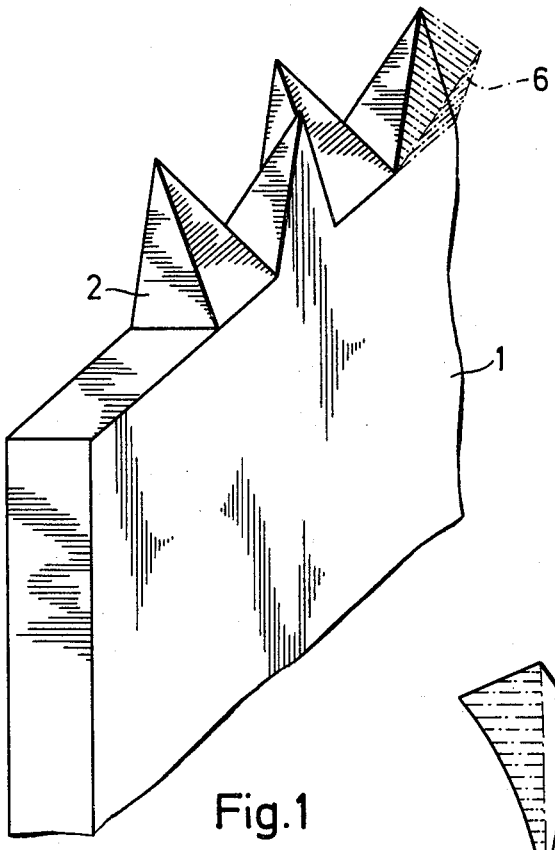
FIG. 1 is a very enlarged, perspective view of the corona discharge element of the invention.
Figure 2:
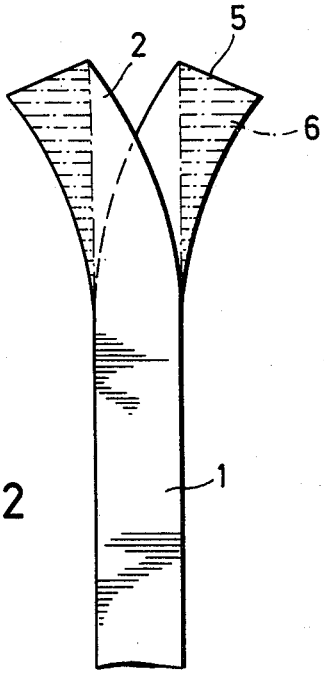
FIG. 2 is an elevational view explaining the manufacture of the corona discharge element of the invention.

In the simplest manner, a corona discharge element of this type may be produced by using, for example, a conventional wood saw blade of 0.6 mm thick tool steel having a pitch of 3 mm and a setting of about 0.6 mm to each side, and grinding it in such a manner that the pyramidal peaks 2 are formed. FIGS. 1 and 2 show, very much exaggerated, how the teeth are set and how they are ground. Before grinding, the teeth of the saw blade consist of laterally projecting metal peaks 5 of approximately prism shape. The laterally projecting areas which are removed by grinding are hatched in FIGS. 1 and 2 and marked with the numeral 6. In order to form pyramidal peaks 2, larger or smaller portions of the saw blade have to be ground off, depending on the thickness of the saw blade and the degree of its setting. It is apparent from the figures, how, by grinding off the hatched areas 6, the prism-like tooth is converted into a pyramidal peak with a genuine point.

The corona discharge element just described was tested in a fatigue test during 400 working hours, which corresponds to the production of 10,000,000 copies in an electrophotographic reproduction apparatus. No substantial reduction of the discharge qualities could be detected. Tests in which a saw blade was used, which had not been ground, failed, however.

Figures 3, 3A, 3B:
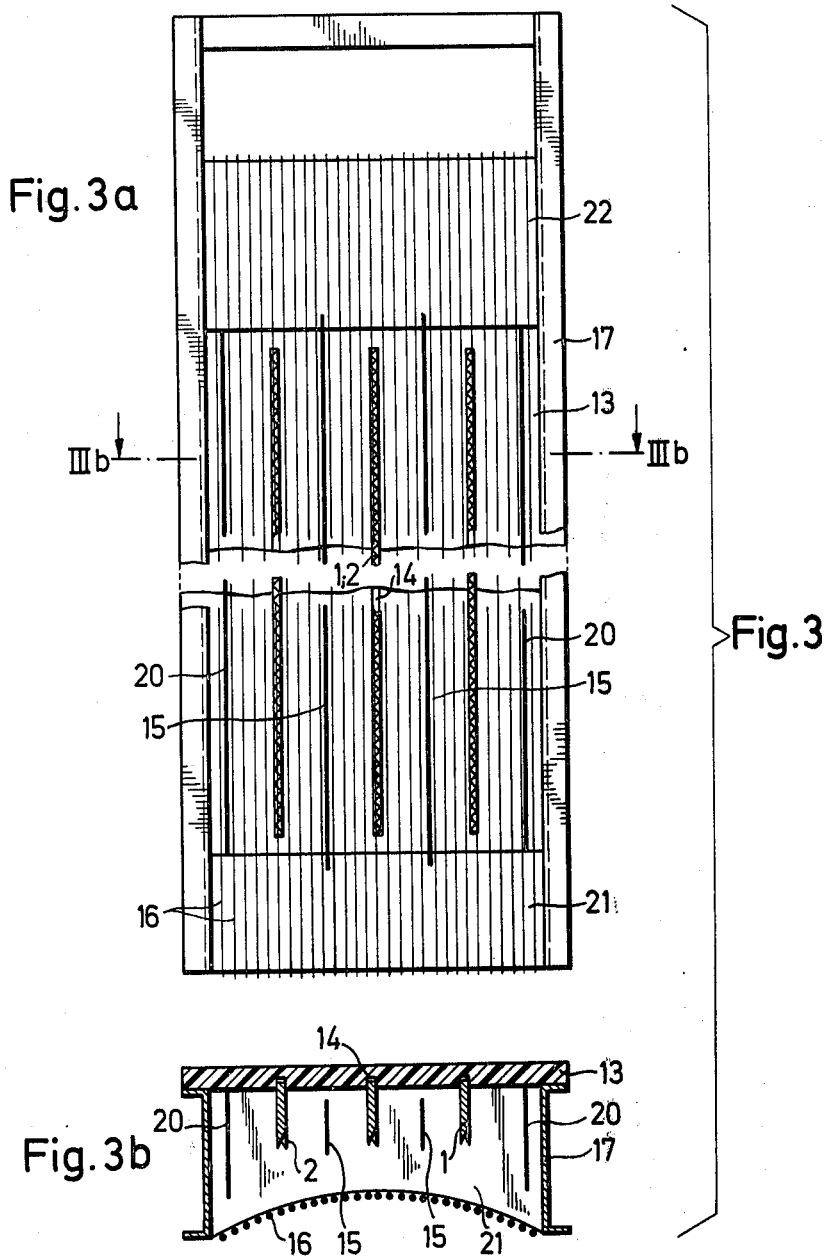
FIG. 3 shows a corona with a sectional view thereof.

FIG. 3 shows a corona, once as a plan view and once as a sectional view. Several electrodes, which are electrically insulated from each other, are mounted in a frame. The frame comprises a base plate 13 which consists of insulating plastic material and contains three longitudinal slots. Three discharge electrodes 1, 2 are mounted in the longitudinal slots 14. The strips 1 are held by the edges of the slots 14 in a clamp fit. The discharge electrodes 1, 2 are of the shape described above in connection with FIGS. 1 and 2. Auxiliary electrodes 15 and 20 are attached to blocks 21 and 22 of plastic material, and the blocks are, in turn, arranged on the base plate 13. The surfaces of the plastic blocks 21 and 22 facing the charge-accepting surface are of concavely curved shape. Grid wires 16 are attached to this side of the plastic blocks 21 and 22 and extend parallel to the discharge electrodes 1/2. The curved shape of the blocks is adapted to the shape of the photoconductor to be charged, which is rotating. Finally, the corona comprises two U-shaped metal rails 17, which form the lateral boundary and screen of the corona.

Figure 4:
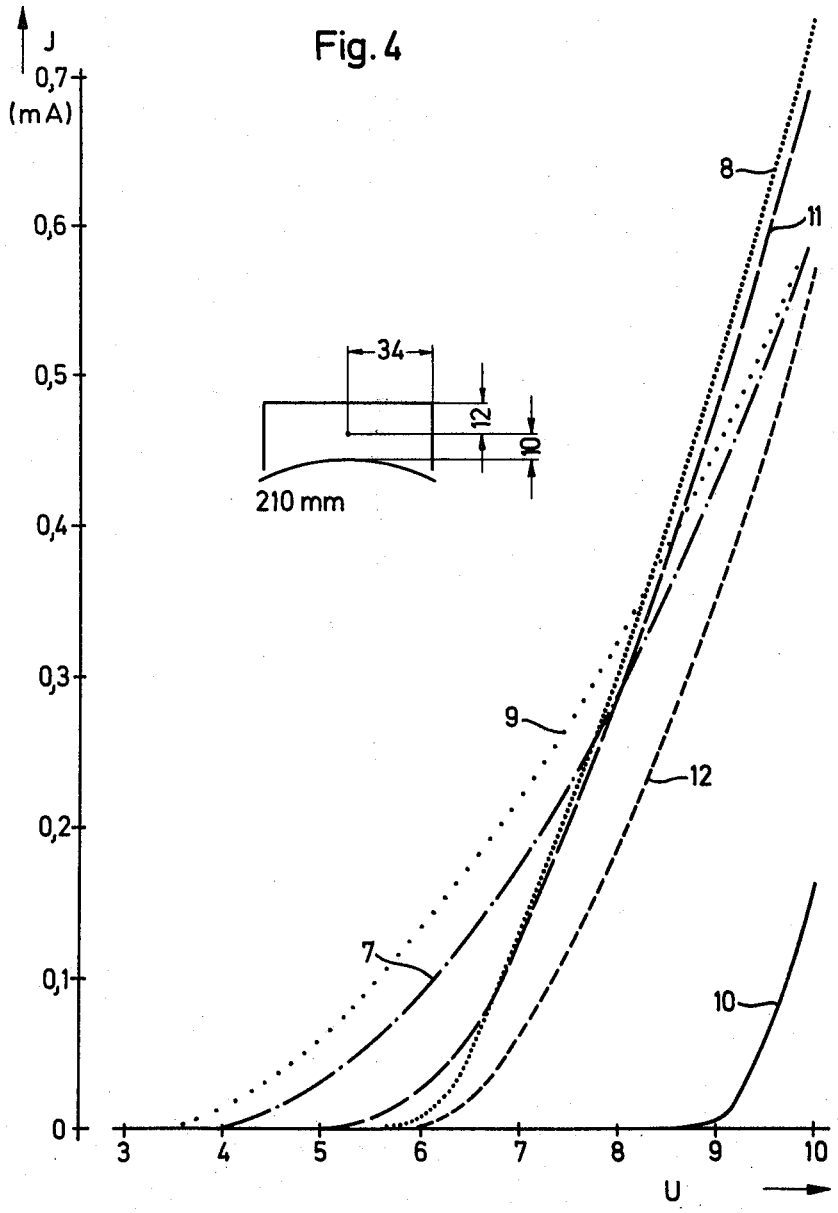
FIG. 4 is a graph showing the discharge behavior of different discharge elements.

FIG. 4 shows the discharged current as a function of the corona voltage, the current being measured by the device schematically shown in FIG. 4. The values indicated are millimeters. The corona discharge element is shown as a dot and is meant to represent all modifications. Curve 7 is the characteristics curve of a wire corona comprising a 54 $\mu$ thick tungsten wire. Curve 8 is the characteristics curve of a needle corona comprising needles of approximately 0.3 mm diameter at a distance of 0.4 mm from each other. Curve 9 is the discharge curve of a needle corona comprising needles of 1.15 mm diameter at a distance from each other of 5 mm. Curve 10 is the discharge curve obtained when using a razor belt (cutting edge type corona). Curves 11 and 12 were produced using the saw blade corona according to the present invention. In the case of curve 11, the corona discharge element consisted of a saw blade of 0.6 mm thickness and a pitch of 6 mm, and in the case of curve 12 the corona was a saw blade of 0.1 mm thickness and a pitch of 1 mm.

It is obvious from the curves, that the corona discharge elements of the present invention are absolutely comparable in their discharge characteristics with known discharge elements. In their manufacture, however, the corona discharge elements according to the present invention are far superior to known coronas, and in their operation they are of a reliability that has been unknown hitherto. Rupture of the corona discharge element according to the present invention is impossible.

What is claimed is:

1. A corona discharge element consisting of a planar metal saw blade, two longitudinal edges of which are provided with two sets of pointed projections, the peaks of one set of projections lying in a plane which contains one side of the blade and the peaks of the other set of projections lying in another plane which contains the other side of the blade, said discharge element comprising:

a. a common plane in which the peaks of all of the projections are lying and which is perpendicular to said planes, b. said projections have the shape of a four-sided pyramid, the base of which is rectangular, c. said bases of adjacent projections are adjoining without clearance between each projection.

2. The corona discharge element according to claim 1, in which the peaks are alternately positioned in the plane of the left and of the right side of the metal saw blade, with one of the four flat sides of the pyramid lying in the plane of the respective side of the metal blade.

3. The corona discharge element according to claim 1, in which the lateral distance between a peak in one set and the nearest peak in the other set is confined to the thickness of the blade.

4. The corona discharge element according to claim 1, in which the distance between the peaks of adjacent projections in a set is substantially constant.

5. A process for the manufacture of a corona discharge element defining a conductive metal blade of determined thickness comprising forming on said blade a plurality of pointed projections which extend laterally beyond the boundary planes in two rows on the upper longitudinal edge of the blade whereby in each of the boundary planes of the blade one row of pyramidal peaks is provided and machining said peaks of both rows to the same height wherein the distance between rows of opposed peaks is confined to the thickness of the blade and said peaks of the opposed rows are staggered.

6. The process of claim 5, including forming the projections as four-sided pyramids with the outermost side of each pyramid being flat and aligned with the respective boundary plane of the blade.

* * * * *